US006343494B2

(12) United States Patent
Roos et al.

(10) Patent No.: US 6,343,494 B2
(45) Date of Patent: Feb. 5, 2002

(54) LOCKING DEVICE

(75) Inventors: Martin Roos, Oestrich-Winkel; Dirk Hipp, Dusslingen, both of (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/369,043

(22) Filed: Aug. 4, 1999

(30) Foreign Application Priority Data

Aug. 11, 1998 (DE) ..... 198 36 199
Jul. 20, 1999 (DE) ..... 199 33 366

(51) Int. Cl.[7] ..... E05B 53/00

(52) U.S. Cl. ..... 70/264; 70/279.1; 70/256; 70/237; 292/144; 292/201

(58) Field of Search ..... 70/208, 237–241, 70/262–264, 256, 257, 277, 279.1; 292/DIG. 23, 29, 42, 43, 144, 201, 216

(56) References Cited

U.S. PATENT DOCUMENTS

| | | | | | |
|---|---|---|---|---|---|
| 1,789,261 | A | | 1/1931 | Kidd | |
| 2,943,879 | A | | 7/1960 | Allen | 292/44 |
| 4,794,268 | A | * | 12/1988 | Nakano et al. | 70/257 X |
| 4,895,009 | A | * | 1/1990 | Kleefeldt et al. | 70/256 X |
| 5,058,258 | A | * | 10/1991 | Harvey | 70/257 X |
| 5,295,374 | A | * | 3/1994 | Bender et al. | 70/208 |
| 5,535,607 | A | * | 7/1996 | Dzurko et al. | 70/237 |
| 5,595,076 | A | * | 1/1997 | Weinerman et al. | 70/208 |
| 5,603,539 | A | * | 2/1997 | Gruhn et al. | 70/237 X |
| 5,636,536 | A | * | 6/1997 | Kinnucan | 70/257 X |
| 5,676,003 | A | * | 10/1997 | Ursel et al. | 70/264 X |
| 5,715,712 | A | * | 2/1998 | West | 70/257 |
| 5,722,272 | A | * | 3/1998 | Bridgeman et al. | 70/264 |
| 5,774,060 | A | * | 6/1998 | Ostermann et al. | 70/256 X |
| 5,841,249 | A | * | 11/1998 | Zimmer et al. | 70/264 X |
| 5,844,470 | A | * | 12/1998 | Garnault et al. | 70/264 X |
| 5,852,943 | A | * | 12/1998 | Dutka et al. | 70/208 X |
| 5,887,466 | A | * | 3/1999 | Yoshizawa | 70/257 |
| 5,905,314 | A | * | 5/1999 | Roundtree | 70/237 X |
| 5,965,953 | A | * | 10/1999 | Ikeda et al. | 70/264 X |
| 6,000,257 | A | * | 12/1999 | Thomas | 70/264 X |
| 6,050,117 | A | * | 4/2000 | Weyerstall et al. | 70/277 |

FOREIGN PATENT DOCUMENTS

| | | | | |
|---|---|---|---|---|
| DE | 1075976 | | 2/1960 | |
| DE | 1104384 | | 4/1961 | |
| DE | 3636828 | | 5/1987 | |
| DE | 19500284 | | 7/1996 | |
| DE | 19545722 | | 4/1997 | |
| DE | 19752974 | | 9/1998 | |
| DE | 19828500 | | 6/1999 | |
| EP | 430732 | * | 6/1991 | 70/256 |
| FR | 2566039 | * | 12/1985 | 70/256 |
| JP | 125078 | * | 5/1990 | 70/264 |
| JP | 209581 | * | 8/1990 | 70/256 |
| JP | 4038247 | * | 2/1992 | 70/256 |
| WO | 9622437 | | 7/1996 | |

* cited by examiner

*Primary Examiner*—Suzanne Dino Barrett
(74) *Attorney, Agent, or Firm*—Martin A. Farber

(57) ABSTRACT

The locking device (10) for doors, in particular of vehicles, has an inside door opener and an outside door handle (12) which can be used to actuate at least one lock for locking the door. Locking devices of this type are conventionally very complicated mechanically, since the mechanical connection between the outside door handle (12) and the lock is meant to be uncoupled as a function of various functional positions. In order to reduce the mechanical complexity, only the inside door opener should act mechanically on the lock, and the outside door handle (12) should act via an electric control on an actuating drive (18), which actuates the lock. In this case, the opening command is instigated only if at least one defined allowable precondition is present. The required additional functions of locking devices can very easily be controlled by the electric control, so that additional mechanical elements are not required. The unlocking with the aid of the inside door opener, which is desired from the point of view of safety, is maintained, and the ease of use is increased because of the lower opening forces of the outside door handle.

11 Claims, 1 Drawing Sheet

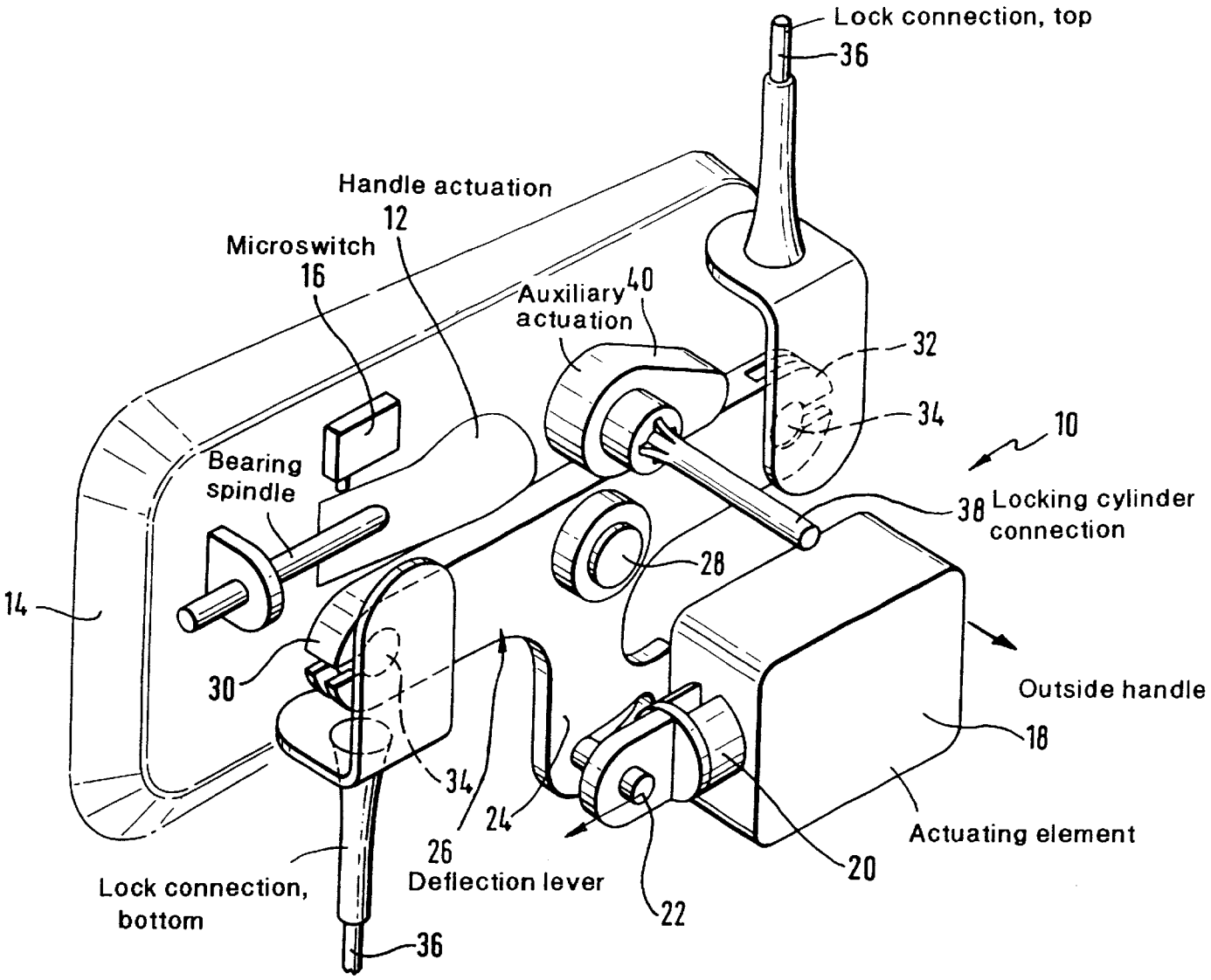
Lock connection, top
36
10
32
34
38
Locking cylinder connection
Outside handle
18
Actuating element
20
28
22
40
Auxiliary actuation
Handle actuation
12
Microswitch
16
Bearing spindle
24
34
26
Deflection lever
36
30
Lock connection, bottom
14

LOCKING DEVICE

FIELD AND BACKGROUND OF THE INVENTION

The invention relates to a locking device for doors or the like, in particular of vehicles, having an inside door opener and an outside door handle which can be used to actuate at least one lock for locking the door.

It is known, for example, in the case of swivel-type tailgates in trucksters, to arrange a locking device, which is connected mechanically to an inside door opener and an outside door handle, in the swivel-type tailgate. Known locking devices already make possible various functional positions which take account of the particular unlocking state, the switching state of a central locking system or a possibly activated anti-theft device when actuating the outside door handle or inside door opener. These manifold requirements mean that the mechanical design of the locking device is very complicated and results in a high outlay on installation, which has an unfavorable effect on the production costs.

SUMMARY OF THE INVENTION

The object of the invention is to provide a locking device for doors which has a simpler mechanical design and nevertheless satisfies all safety requirements with, at the same time, an improvement in the ease of use.

According to the invention, the object is achieved in that in the case of a locking device of the type described at the beginning, only the inside door opener acts mechanically on the lock, and the outside door handle is mechanically uncoupled from the lock, which can be actuated via an actuating drive which is coupled to the outside door handle via an electric control, the control instigating at least the opening command for the lock, when the outside door handle is moved into its opening position, only under at least one defined allowable precondition.

Because of the mechanical coupling of the inside door opening to the locking device, the solution according to the invention provides the possibility, on the one hand, of always being able to open the door in an emergency from the inside, irrespective of functional positions, for example, of the central locking system or of an anti-theft device. On the other hand, the omission of the mechanical connection between the outside door handle and the locking device considerably simplifies the mechanical design, since the hitherto necessary additional mechanical elements for realizing a locking position, anti-theft protection or the like, can be dispensed with. Rather, in the solution according to the invention the outside door handle electrically activates, via the control, an actuating drive which realizes the actual opening of the lock. The additional functional positions can be regarded, via the control, as simple logical connections without an additional mechanical outlay being necessary.

Since, when the outside door handle is actuated, the unlocking of the lock elements takes place exclusively by the actuating drive, the operating forces for the opening movement of the outside door handle are considerably reduced. It is merely necessary to overcome the force of an optionally present restoring spring which pulls the outside door handle back into its "closed position" when it is not actuated.

As the allowable precondition under which the control instigates the opening movement of the actuating drive, the control can detect the opened state of a central locking system or the unlocked position of a mechanical locking cylinder, for example, via a microswitch, or it can take into account the corresponding radio signal of a transponder which the user carries on him. When the outside door handle is actuated into the open position, this transponder is activated by a radio signal and emits a certain coded signal which, when it agrees with a code deposited in the control, is regarded as the allowable precondition for the opening. Transponders of this type are known per se and may be integrated into the vehicle key or in a separate chip card. A certain coded signal from a radio remote control may also be used by the control as the allowable precondition. The abovementioned allowable preconditions may be logically AND-connected individually to the opening signal of the outside door handle, it also being possible for a plurality of allowable preconditions to be evaluated by the control by a logic AND-connection or OR-connection.

The open position of the outside door handle is detected in a particularly simple manner by a microswitch which transmits an electric signal to the control.

In order to be able to open the door from the outside even if the microswitch, the control or the actuating drive has a defect, in a preferred embodiment of the invention provision is made for the lock to be able to be mechanically unlocked with the aid of a locking cylinder which can be actuated from the outside and is independent of the outside door handle. An emergency opening option of this type is coupled with the use of a suitable key and can therefore be of very simple mechanical design.

The locking device according to the invention can be used particularly advantageously in the case of a swivel-type tailgate, for example, of a delivery vehicle, which has an upper and lower lock which are coupled mechanically via actuating elements to a deflecting device on which the inside door opener, the actuating drive and, if present, the locking cylinder engage mechanically. However, in addition to this use the locking device according to the invention is suitable in the same manner for other vehicle doors, in particular also for sliding doors of minibuses. In this case, the locking device only has one lock which may, in a manner known per se, consist of a rotary latch and a pin, for example.

The deflecting device is expediently designed as a deflecting lever on whose lever arms the actuating elements, the actuating drive and, if appropriate, the locking cylinder engage. The deflecting lever may, for example, have a respective lever arm for the two actuating elements, which are designed, for example, as push rods, and a lever arm for the actuating drive, the connection at the ends of the lever arms in each case comprising a joint. This makes a simple coupling to the actuating drive possible even when there are two locks. Instead of the push rods, the use of other push or pull elements is also conceivable. However, push rods make a particularly simple design possible, since their ends on the upper and lower end of the swivel-type door can engage as locking pins directly into suitable fittings in recesses on the body.

The use of a deflecting lever also allows a particularly simple mechanical engagement of the locking cylinder, which is preferably connected to an eccentric element which acts on a lever arm of the deflecting layer.

BRIEF DESCRIPTION OF THE DRAWING

In the following, an exemplary embodiment of the invention is entered into in more detail with reference to the sole attached drawing.

The FIGURE shows a locking device 10 which is used for locking a swivel-type tailgate of a truckster.

DETAILED DESCRIPTION OF THE PREFERRED EMBODIMENT

The locking device 10 comprises an outside door handle 12 which is arranged in a pivotable manner in a recessed grip 14 in the swivel-type tailgate. The handle 12 can be moved counter to the force of a restoring spring (not shown) from a closed position into an opened position in which a microswitch 16 is activated. On detecting the locking position, the microswitch 16 transmits an electric signal to a control (not shown) which activates an electric actuating drive 18 when further allowable preconditions, which will be entered into below, are present. The actuating drive 18 acts on a push element 20 which engages via a joint 22 on a first lever arm 24 of a deflecting lever 26. The deflecting lever 26 is mounted on the vehicle door in a manner such that it can rotate about a pivot 28. As the actuating drive, apart from lifting elements, for example, solenoids, pneumatic or hydraulic cylinders, an electric motor, which is coupled to the push element 20 via a spindle drive, is also possible.

The deflecting lever 26 furthermore has a second and third lever arm 30, 32 whose ends are in each case provided with a joint 34, the joints being connected to push rods 36 which transmit the movement instigated by the actuating drive 18 to locks (not shown) arranged on the upper or lower edge of the swivel-type door. In the simplest case, these locks can lock the door by those ends of the push rods 36 which are designed as pins interacting with fittings on the body.

Furthermore, a locking cylinder is provided in the vehicle door, which cylinder, in addition to the conventional functions, for example, of providing a connection to a central locking system, is also coupled, via a driver 38, to a cam disk 40 which, when the locking cylinder 36 is rotated, acts on the third lever arm 32 of the deflecting lever 26 and thereby makes possible, if the electrics or individual components fail, auxiliary opening of the door by unlocking the locks.

An inside door opener, which is accessible from the interior of the vehicle, is furthermore attached in a fixed manner to the deflecting lever 26, the inside door opener making it possible for the vehicle door to be opened from the inside and thereby taking account of safety requirements.

The control (which is not shown in more detail) is furthermore able, when the actuating drive 18 is activated, not only to evaluate the signal of the microswitch 16 but also further functional signals. When the microswitch 16 is closed, an instigation of the opening of the locks via the actuating drive 18 is only instigated if at least one further allowable precondition is present. This may, for example, happen whenever the locking cylinder is in an unlocked position, it being possible for this position to be detected by a microswitch. It is furthermore conceivable for the control to detect the opened state of a central locking system and in this state, when the microswitch 16 is closed, to activate the actuating drive 18.

The inclusion of a certain coded signal of a remote control or a transponder, which is activated by the control, may also be provided as the allowable precondition for opening the locking device.

Of course, it is conceivable for the actuating drive 18, in the case of other locking devices, to be able to act on the corresponding elements of a lock in order to instigate the opening of the door. The above-described solution of a mechanically uncoupled outside door handle 12 is, in principle, suitable for all types of locks as can be found, for example, in the case of swiveling doors or sliding doors or hoods and tailboards of motor vehicles.

We claim:

1. A locking device for doors or the like, in particular of vehicles, having an inside door opener and an outside door handle (12) which can be used to actuate at least one lock for locking the door, wherein only the inside door opener acts mechanically on the lock, and the outside door handle (12) is mechanically uncoupled from the lock, which can be actuated by an actuating drive (18) which is coupled to the outside door handle (12) by an electric control, the control instigating at least the opening command for the lock, when the outside door handle (12) is moved into an opening position, only under at least one defined allowable precondition;

said at least one precondition being at least one of detection by the control of an opened state of a central locking system or a detection by the control of an unlocked position of a mechanical locking cylinder or a responding by the control to a radio signal of a remote controller as well as a transponder activated by the radio signal, or a detection by a microswitch with a signaling of the control of an open position of the outside door handle.

2. The locking device as claimed in claim 1, wherein as the allowable precondition the control detects the opened state of a central locking system.

3. The locking device as claimed in claim 1, wherein as the allowable precondition the control detects the unlocked position of a mechanical locking cylinder.

4. The locking device as claimed in claim 1, wherein as the allowable precondition the control takes into account the corresponding radio signal of a remote control or of a transponder activated by the radio signal.

5. The locking device as claimed in claim 1, wherein a microswitch (16) detects the open position of the outside door handle (12) and transmits a signal representing the open position to the control.

6. The locking device as claimed in claim 1, wherein the lock can be mechanically unlocked with the aid of a locking cylinder which can be actuated from the outside and is independent of the outside door handle (12).

7. The locking device as claimed in claim 1, wherein the door is a swivel-type tailgate of a vehicle, which has an upper and a lower lock which are coupled by actuating elements (36) to a deflecting device (26) on which the inside door opener, the actuating drive (18, 20) and a locking cylinder engage mechanically.

8. The locking device as claimed in claim 7, wherein the deflecting device is formed as a deflecting lever (26) on whose lever arms (24, 30, 32) the actuating elements (36), the actuating drive (18, 20) and a locking cylinder engage.

9. The locking device as claimed in claim 8, wherein the deflecting lever (26) has a respective lever arm (30, 32) for the two actuating elements, which are designed as push rods (36), and a lever arm (24) for the actuating drive (18, 20), the connection at the ends of the lever arms (24, 30, 32) in each case comprising a joint (22, 34).

10. The locking device as claimed in claim 8, wherein the locking cylinder is connected to an eccentric element (40) which acts on a lever arm (32) of the deflecting lever (26).

11. A locking device for doors of vehicles having an inside door opener and an outside door handle (12) usable to actuate at least one lock for locking the door, wherein the inside door opener acts mechanically on the lock, and the outside door handle (12) is mechanically uncoupled from the lock, which is actuatable by an actuating drive (18) which is coupled to the outside door handle (12) by an electric control, the control commanding an opening of the lock when the outside door handle (12) is moved into an opening position and upon detection of an opened state of a central locking system or an unlocked position of a mechanical locking cylinder or a responding by the control to a radio signal of a remote controller as well as a transponder activated by the radio signal, or a detection by a microswitch with a signaling of the control of an open position of the outside door handle.

* * * * *